US005083665A

United States Patent [19]

Schoenberg et al.

[11] Patent Number: 5,083,665

[45] Date of Patent: Jan. 28, 1992

[54] PACKAGING FOR X-RAY FILMS

[75] Inventors: Allan R. Schoenberg, Asheville; Davie W. Summey, Brevard; James B. Kisner, Flatrock; Kenneth W. Frady; John D. Wood, both of Pisga Forest; Mark J. Zdanowicz; James L. Lancaster, both of Hendersonville; Stanley A. Robinson, Asheville, all of N.C.

[73] Assignee: E. I. Du Pont de Nemours and Company, Wilmington, Del.

[21] Appl. No.: 559,782

[22] Filed: Jul. 30, 1990

[51] Int. Cl.[5] ..... B65D 85/48

[52] U.S. Cl. ..... 206/455; 206/454; 378/186; 378/187

[58] Field of Search ..... 206/454, 455; 378/182, 378/186, 187, 188

[56] References Cited

U.S. PATENT DOCUMENTS

| | | | |
|---|---|---|---|
| 3,348,042 | 10/1967 | Umberg et al. | 378/186 |
| 3,458,033 | 7/1969 | Ariyasa et al. | 206/455 |
| 3,645,388 | 2/1972 | Fessenden | 206/455 |
| 3,958,693 | 5/1976 | Greene | 378/187 |
| 4,438,164 | 3/1984 | Pfeifer et al. | 206/455 |
| 4,869,368 | 9/1989 | Hara | 206/455 |
| 4,915,229 | 4/1990 | Yamada et al. | 206/455 |

*Primary Examiner*—David T. Fidei

[57] ABSTRACT

A novel process for the packaging of double-side coated X-ray films is described. This process employs the use of plastic or plastic or polymer coated cardboard as top and bottom stiffening members in a stack of sheets of the X-ray film. The top and bottom sheets of film packaged in this manner will harden in the same way as the remainder of the sheets whereas film packaged with conventional, plain cardboard stiffening members will not.

3 Claims, 3 Drawing Sheets

PACKAGING FOR X-RAY FILMS

BACKGROUND OF THE INVENTION

1. Field of the Invention

This invention relates to packaging materials and specifically to packaging materials used for photographic elements. Still more specifically, this invention relates to packaging materials which are used with double-side coated X-ray photographic elements.

2. Background of the Invention

Photographic elements are light sensitive and must be packed for shipping with a great deal of care. This care is needed since the packaging must be light tight. Additionally, since the elements themselves are generally soft and subject to abrasion and the like, care must be taken to prevent damage during shipment. This damage (e.g., abrasion damage) is usually caused by individual sheets of film rubbing together within the packaging material.

Photographic X-ray elements require a high degree of packaging safety since any small mark or abrasion in the film may be mistaken during the X-ray evaluation of a patient, for example. X-ray film elements are usually finished in varying convenient sizes. These are usually sheets of sizes conventional in the medical X-ray industry such as 8 inches by 11 inches, or 10 by 14, among others. Sheets of these films are usually wrapped within a black, plastic bag (e.g., polyethylene) to prevent light leakage which might tend to expose the sensitive elements. This bag is usually placed within a conventional box made of some durable material such as cardboard. In order to prevent individual film sheets from movement within this box, it is usually conventional to include a stiffener on the top and on the bottom of the pack of film sheets prior to insertion within the bag. This stiffener is conventionally a sheet of cardboard of the approximate same size as the individual sheets of film which make up this package. At this point, after the bag which includes the stiffener sheets and the film sheets, is placed within the box, the entire package is sealed, labeled and is ready for shipment.

Photographic, X-ray elements conventionally are made by coating photosensitive emulsion (e.g., gelatino silver halide emulsions) on both sides of a support. An abrasion layer which usually comprises a gelatin layer containing hardeners or cross-linkers for the gelatin, is usually coated on top of each of the photosensitive layers mentioned above. Since this element is usually coated on a wide, long roll of the support (e.g., polyethylene terephthalate film), it must be chopped or finished to the requisite size before packaging. Hardening is still occurring during this step and sometimes the sheets of film have not reached the peak or optimum hardening stage prior to finishing and packaging. Thus, the photosensitive layer which will ultimately face the cardboard stiffener, for example, is still under-going this hardening step. These sheets of film tend to lose hardener which may be adsorbed by the cardboard sheet and thus the hardening of these particular elements is strongly affected by the presence of these stiffener sheets. There is, then, a pressing need to improve the stiffener elements used within the packaging systems of double-side coated X-ray film elements.

SUMMARY OF THE INVENTION

It is an object of this invention to provide a suitable packaging system for the packing of sheets of photosensitive, double-side coated X-ray elements. It is a further object of this invention to provide a packaging system that will not affect the sensitometry and physical aspects of these elements during shipment. These and yet other objects are achieved in a package surrounding a plurality of sheets of photosensitive silver halide elements, said elements comprising a support having at least one silver halide emulsion layer coated on either side thereof and wherein each of said emulsion layers is overcoated with an abrasion layer, and wherein each of said layers contain gelatin and at least one cross-linking agent, and wherein said packaging contains at least one stiffening support element facing at least one of said emulsion layers of one of said sheets, the improvement wherein said stiffening support element contains a surface which contacts the emulsion layer which surface is plastic. The support element is preferably a thick, nonporous plastic sheet or cardboard coated with a plastic.

DETAILS OF THE INVENTION

Figure 1:
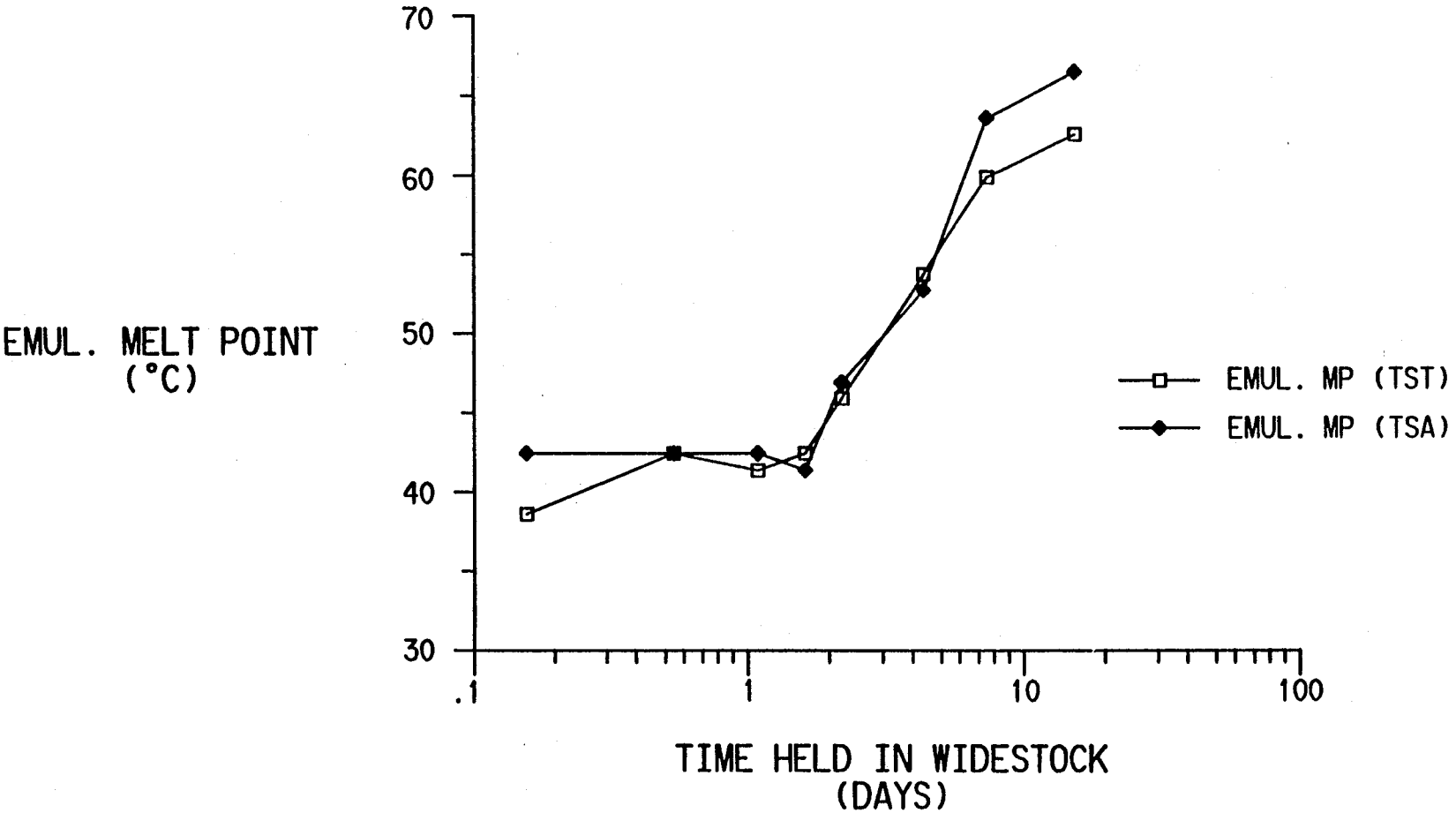
FIG. 1 is a graph showing emulsion melting point vs. storage time of data presented in Example 1.

In the manufacture of photographic, X-ray film, it is conventional to produce the emulsion using gelatin and precipitated silver halide grains. These grains are usually silver bromide and may also contain small amounts of silver iodide but may also be made from any of the conventional silver halides including the chlorides or mixtures thereof. These grains may be formed in any of the conventional grain shapes (e.g., round, cubic or tabular) and are usually bulked up with gelatin before being brought to their optimum sensitivity with gold and sulfur or other conventional sensitizing agents. Dyes to optimize the region of emulsion sensitivity may also be present as well as the usual wetting agents, antifoggants, coating aides, etc. The emulsion may also contain gelatin cross-linking agents in order to harden the emulsion and increase film utility during handling. The emulsions designed for medical X-ray applications must be coated at a fairly high coating weight in order to possess the requisite sensitivity. It would be difficult to coat this higher coating weight on a single side of a support. Thus, it is conventional to apply part of the emulsion on one side and the remainder on the other yielding a double-side coated element. Over each emulsion layer a thin, antiabrasion coating is usually applied. This coating is conventionally made from gelatin in which additional or alternate cross-linking or hardening agents are included. These hardeners not only serve to harden the antiabrasion layer but additionally migrate down to the emulsion layer and improve the hardening there also. These conventional hardening or cross-linking agents commonly used in the photographic industry include formaldehyde, chrome alum, glutaraldehyde, various triazines among many others. Most of these hardeners perform their function by cross-linking various groups present in the gelatin which is a major part of the emulsion. Most of these hardeners do take some time to fully achieve a final degree of cross-linking.

Most X-ray photographic systems employ a minimum of hardening in the emulsion or antiabrasion layer and include extra hardener within the developing system to insure that the final, exposed and developed X-ray product has the needed hardening. However, it is becoming more and more evident that systems which will employ all of the requisite hardening in the photographic element and eliminate most or all of the hardening in the developer (so-called "forehardening" systems), will in the future occupy an increasing amount of the market share. Thus, it will be necessary to increase those hardener levels in the emulsion and antiabrasion in order to meet these market needs.

Conventional medical X-ray, double-side coated elements employ supports that are essentially transparent. These elements are usually films such as dimensionally stable, polyethylene terephthalate (preferred) that contains a thin, anchoring substratum of a conventional and well-known resin over which a thin, gelatin layer is coated. These two subbing layers are applied on both sides of the film support and assist in the anchoring and coating of the aqueous photographic emulsions. A blue dye is conventionally added to the polyethylene terephthalate during manufacture to impart a blue tint to the finished product.

Coating of double-side X-ray elements is achieved in the usual manner by skim, air knife, bar, or other conventional coating methods. The film support is then wound up into a large roll which is then introduced into the coating system. The aforementioned layers are then applied to this support as is well-known in the art. The coated film may be rolled up and held for a period of time before being chopped or finished into the requisite and desired sizes. During this time, the desired, full hardening of the element is achieved. However, if this film is not held for a sufficient period of time, the hardening process will not be complete prior to finishing. Thus, these particular elements present a considerable problem if they are finished and packaged prior to completion of the hardening step.

In the modern photographic film manufacturing sites it is becoming a conventional practice to prepare films for finishing and packaging just-in-time so as to prevent the presence of large inventories of film and to better utilize the manufacturing facilities. Thus, the problems associated with the hardening as described above are now becoming more evident.

After the film is coated with the emulsion, finishing to the appropriate sizes occurs. The rolls of film are slit and chopped into sheets and these sheets must be packaged prior to shipment. The pack of film sheets are usually stiffened before being wrapped in a black, plastic bag, for example, and then inserted into a shipping box. These stiffening members are usually cardboard and serve to firm up the package of film and to insure a tight fit within the box. However, one layer of photographic emulsion from the top and bottom sheet of the stack will always face the cardboard stiffening element. Thus, if hardening is not complete the emulsion is still soft and the hardener may exude into the cardboard stiffener and be lost to the process. Then, these two, individual sheets of film will have different integrity and sensitometry than desired when compared to the remaining sheets of film within the same box. This cannot be tolerated within this industry and thus it is becoming a problem which requires a solution. And, this solution is achieved by the practice of this invention which requires that a stiffening member is plastic, i.e., a polymeric material and preferably selected from the group consisting of a non-porous plastic sheet and cardboard coated with a plastic.

The type of plastic, i.e., polymer, which is employed in the present invention is not critical but it will be inert to the surface of the photographic element.

Thus, if a plastic surface, e.g., a thick, plastic, nonporous sheet (e.g., 7 mil or greater thickness) is used in place of plain cardboard to increase the rigidity of the package of film sheets good results are also obtained sentiometrically. Also, polymer coated cardboard may also be used, in fact it is so preferred. Preferred plastic sheets comprise thick polyethylene terephthalate films, subbed or unsubbed or may contain a thin layer of polyethylene, for example, coated thereon. In another embodiment, the plastic sheet or layer may be additionally coated with a matte finish so as to assist in the handling of the stacks of film sheets. This is a particularly preferred embodiment since if one uses a plastic sheet or a cardboard coated with plastic, the stack of film in association therewith becomes difficult to handle during the packaging step. The matte finish thus precludes the extra slipping which occurs when the plastic finish comes in contact with the slippery photographic film element. The matte layer may comprise any of the well-known matte agents therein, such as small particles of $SiO_2$ or small polymer beads, or produced by passing the coated polymer cardboard through textured rollers during its manufacture for example. Other antistatic agents may also be incorporated in this coating to further assist in the handling thereof.

Figure 3:
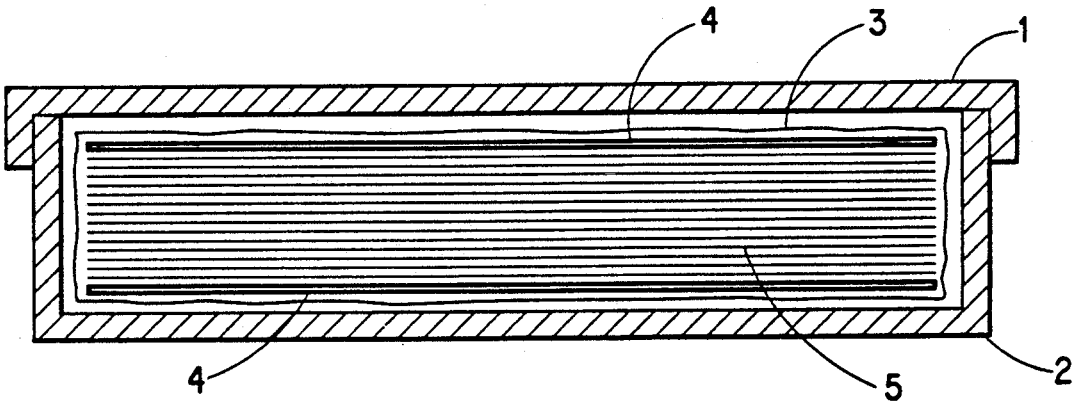
FIG. 3 is a sectional end view of a box containing a plurality of X-ray photosensitive films and two support stiffing elements.

A typical package within the scope of the present invention is shown in FIG. 3. A cross-sectional view of a box which can be cardboard is shown and it comprises a removable top 1 and a bottom section 2 which holds a plurality of X-ray film sheets 5. Two plastic stiffening elements 4 are shown with one element present below the X-ray film and a second element above the film. A plastic bag 3 surrounds the X-ray film and the stiffener elements.

This invention will now be illustrated by the following examples where all parts and percentages are by weight unless otherwise indicated.

EXAMPLE 1

Cronex® 10L Type 576 emulsion is coated at 4.25 gm $Ag/M^2$ on a 7 mil polyester substrate and contains 288 gm of gelatin (K&K type 2688) per mole Ag (silver iodobromide, 2% I). The gelatin is distributed in the final coating such that for every gram of emulsion gel there is 0.467 grams of overcoat or abrasion gel. Formaldehyde is added to the abrasion such that its overall concentration $1.04\times10^{-3}$ gm/gm of gelatin. The emulsion is coated and held in widestock for various periods of time before it was sent through a finishing process. Boxes were then sent to the control laboratory where emulsion melting points are determined. Such melting points determine how long the emulsion should remain in widestock before sufficient hardening is achieved so that after it is finished (slit, chopped and packaged) the sheet next to standard cardboard will have sufficient hardiness to withstand typical customer handling (through transport equipment and developing).

The test procedure involved placing a film sample in a distilled water bath. The bath is heated at a constant rate as the sample is lifted slowly from the bath. The point at which the emulsion separates from the base is considered the emulsion melt point. Typically, emulsion melt points of 55+° C. are needed to achieve customer and use requirements.

The results are shown in FIG. 1. These results show film should be held in widestock for a minimum of five days, preferably ten days before sufficient hardness is achieved. A typical medical X-ray film package has 100 sheets of photographic film with two sheets of cardboard on the top and bottom of the stack. This stack is placed in a polyethylene pouch, sealed and placed in a box.

EXAMPLE 2

In this example the effect of film hardness of the coated emulsion of Example 1 is determined a top and bottom sheet (toward and away from a packaging material) using various packaging materials (including competitors cardboards). The procedure involves sending emulsion coated widestock through a finishing procedure where films are packaged with standard cardboard, various competitor cardboards, polycoated cardboard (0.75 mil polyethylene) and subbed and unsubbed base. These boxes are then stored for 17 days and sent for testing melt point of the top and bottom sheet (both toward and away from the cardboard) and the middle sheet. The results are as follows:

TABLE 1

| | M.P (°C.) AFTER 17 DAYS OF BOX STORAGE | | | | | |
|---|---|---|---|---|---|---|
| | Top Sheet | | Middle Sheet | | Bottom Sheet | |
| Sample | Toward | Away | Toward | Away | Toward | Away |
| 1 - Cardboard | 36 | 65 | 56 | 66 | 61 | 37 |
| 2 - Cardboard | 34 | 67 | 58 | 68 | 62 | 35 |
| Manufacturer A 3 - Cardboard | 36 | 66 | 59 | 67 | 62 | 39 |
| Manufacturer B 4 - Cardboard | 36 | 67 | 63 | 67 | 65 | 39 |
| Manufacturer C 5 - Cardboard | 37 | 67 | 62 | 67 | 65 | 38 |
| Manufacturer D 6 - Cardboard | 37 | 63 | 64 | 67 | 67 | 38 |
| Manufacturer E 8 - Polycoated Cardboard | 66 | 70 | 68 | 70 | 70 | 66 |
| 9 - Polyester (unsubbed) | 62 | 67 | 62 | 67 | 65 | 67 |
| 10 -Polyester (subbed) | 64 | 67 | 64 | 67 | 65 | 67 |

The results of the table show the melt point of the film held next to cardboard in all instances remain unacceptability low (below 40° C.), while that of the polycoated board and the subbed and unsubbed polyester base have melting points (i.e., have aged) similar to the coating away from the board and the middle sheet of the box. Therefore, packaging film by coating the cardbox or substitution of a plastic material allows all film including the top and bottom sheet, to age similar to the rest of the film pack.

EXAMPLE 3

Figure 2:
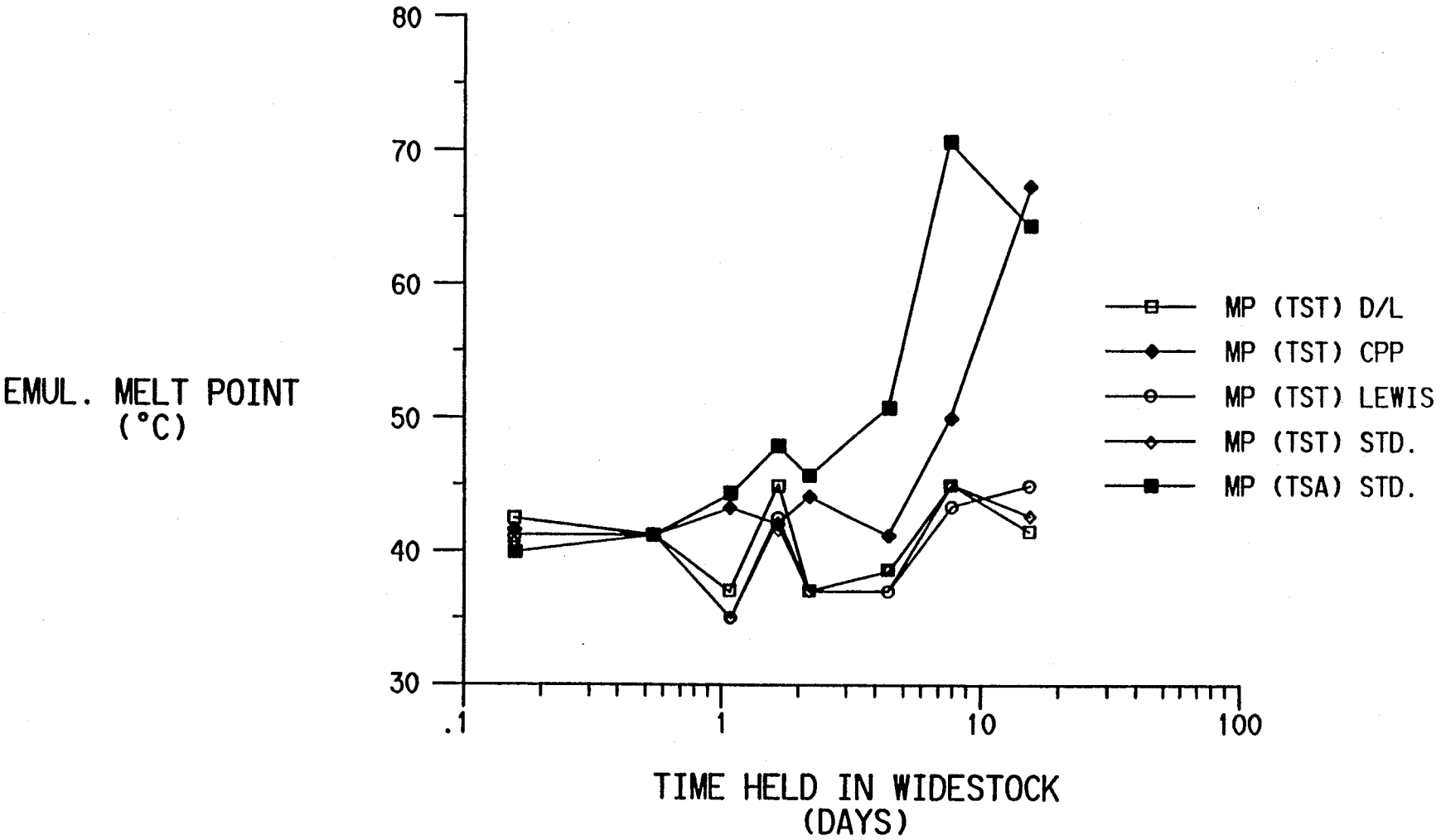
FIG. 2 is a graph showing emulsion melting point vs. storage time of data presented in Example 3.

Freshly coated Cronex® 10L emulsion film is sent through finishing and several boxes of the film are packaged with various cardboard inserts for cardboard, Lewis cardboard, Daylight® cardboard and polycoated casted cardboard (CPP board). Periodically boxes of the film are sent for melt point testing. The results of the test are shown in FIG. 2.

The results show that only a film packaged with polycoated CPP board has its top sheet next to the insert continuing to increase in melt point. Therefore only film packaged with a polymer coated insert shows in its top sheet an increase in hardening which is considered to harden at a similar rate as the remainder of the film in the box.

Additionally, it has been found to be beneficial for the polymer coated cardboard to have a matte finish which aids in the handling process through the finishing process. Furthermore, it has been found to be useful to have the polycoated cardboard treated with an antistatic treatment. Several common antistatic agents are possible including conductive carbons, metal oxides, polymers, surfactants and surfactant combinations.

We claim:

1. In a package surrounding a plurality of sheets of photosensitive silver halide elements, said elements comprising a support having at least one silver halide emulsion layer coated on either side thereof and wherein each of said emulsion layers is overcoated with an abrasion layer, and wherein each of said layers contain gelatin and at least one cross-linking agent, and wherein said package contains at least one stiffening support element which faces at least one of said emulsion layers wherein the improvement comprises said support stiffening element is cardboard coated with a plastic and wherein said plastic has a matte surface coated with an antistat which faces the emulsion layer.

2. The package of claim 1 wherein the plastic is a non-porous plastic sheet on a cardboard coated with plastic.

3. The package of claim 1 wherein said antistat comprises a surfactant.

* * * * *